US009936770B2

(12) United States Patent
Tsai

(10) Patent No.: US 9,936,770 B2
(45) Date of Patent: Apr. 10, 2018

(54) BUCKLE

(71) Applicant: Yun-Chan Tsai, Kaohsiung (TW)

(72) Inventor: Yun-Chan Tsai, Kaohsiung (TW)

( * ) Notice: Subject to any disclaimer, the term of this patent is extended or adjusted under 35 U.S.C. 154(b) by 271 days.

(21) Appl. No.: 14/846,740

(22) Filed: Sep. 5, 2015

(65) Prior Publication Data

US 2017/0065034 A1 Mar. 9, 2017

(51) Int. Cl.
*A44B 11/12* (2006.01)

(52) U.S. Cl.
CPC ..... *A44B 11/12* (2013.01)

(58) Field of Classification Search
CPC .... A44B 11/12; A44B 11/125; Y10T 24/4016
See application file for complete search history.

(56) References Cited

U.S. PATENT DOCUMENTS 2,981,993 A * 5/1961 Elsner ..... A44B 11/12 24/170
3,011,237 A * 12/1961 Prete, Jr. ..... A44B 11/12 24/170
3,177,545 A * 4/1965 Svensson ..... A44B 11/14 24/170
3,252,193 A * 5/1966 Matthews ..... A44B 11/12 24/170
3,413,691 A * 12/1968 Elsner ..... A44B 11/14 24/134 R
3,608,158 A * 9/1971 Bengtsson ..... A44B 11/12 24/170
5,160,186 A * 11/1992 Lee ..... A44B 11/2549 297/476
6,543,096 B2 * 4/2003 Settelmayer ..... A44B 11/12 24/170
6,560,825 B2 * 5/2003 Maciejczyk ..... A44B 11/14 24/170
6,735,826 B2 * 5/2004 Uehara ..... A44B 11/12 24/170
6,868,585 B2 * 3/2005 Anthony ..... A44B 11/14 24/134 R
7,343,650 B2 * 3/2008 Baldwin ..... A44B 11/14 24/503
7,478,459 B2 * 1/2009 Kawaguchi ..... A44B 11/12 24/170
8,327,513 B2 * 12/2012 Keene ..... A44B 11/2526 24/637
8,464,402 B2 * 6/2013 Mamie ..... B60P 7/0823 24/170

(Continued)

*Primary Examiner* — Jason W San

(57) ABSTRACT

A buckle for adjusting a length of a strap includes a first body and a locking unit. The first body has a first body unit having a first main body surrounding a containment space, a first through hole and a second through hole disposed separately on the first main body, and a first rod disposed in the containment space. The locking unit has a columnar shape and disposed in the containment space, the locking unit further having two flat surfaces, a side surface connected between an edge of each flat surface, and a supporting aperture accepting the first rod. Each side surface further has a first curved portion, a vertical surface connected to the first curved portion at one end and a second curved portion connected to another end of the vertical surface, and a first protrusion connected to both of the first curved portion and the second curved portion.

3 Claims, 12 Drawing Sheets

(56) References Cited

U.S. PATENT DOCUMENTS

| | | | | |
|---|---|---|---|---|
| 8,561,267 | B2 * | 10/2013 | Chang | A44B 11/12 211/89.01 |
| 8,635,746 | B2 * | 1/2014 | Bellamy | A61B 17/1327 24/170 |
| 8,763,210 | B2 * | 7/2014 | Vincent | A43B 5/04 24/68 SK |
| 9,149,091 | B2 * | 10/2015 | Ishii | A44B 11/12 |
| 9,351,539 | B2 * | 5/2016 | Briggs | A43C 11/146 |
| 9,622,547 | B2 * | 4/2017 | Seader | A44B 11/12 |
| 9,775,410 | B2 * | 10/2017 | Szewczyk | A44B 11/125 |
| 2016/0166013 | A1 * | 6/2016 | Szewczyk | B60R 22/30 297/468 |
| 2016/0360837 | A1 * | 12/2016 | Costenbader | B60P 7/0823 |

* cited by examiner

BUCKLE

BACKGROUND OF THE INVENTION

1. Field of the Invention

The present invention relates to a buckle, and more particularly to a buckle with an adjustable strap.

2. Description of the Related Art

Typical backpack buckles with adjustable straps are made of plastic. Backpack straps with multiple bends increase the surface friction of the strap and allow users to use the buckle to adjust the length of the strap, so the user can have a strap with the appropriate length.

Referring to FIG. 1, a buckle 10 is usable, for example, in a backpack, and can connect to another buckle. The buckle 10 comprises: an advancing belt body 2 (2A), which can move in the longitudinal direction and can be fixed at an arbitrary position; and an adjustable belt 3 (3A) to adjust length, which is formed by a ribbon-like body having a predetermined width.

The conventional buckle 10 includes a locking member that secures the belt 2 (2A) in position, but in use has the following disadvantages:

Poor Lifetime

To save costs, the buckle is made from plastic, and so when the backpack is exposed to sun and rain, the plastic can quickly deteriorate.

Poor Loading Capabilities

The plastic buckle not only has a poor lifetime, but the softness of the plastic material can also impose load limits on the backpack.

Additionally, the overall operations of the conventional locking member 31 is inconvenient.

Alleviating the above disadvantages so that a user can enjoy quick adjustments of the strap length, while also both lifetime and loading capabilities, are important issues in the art.

Therefore, it is desirable to provide a buckle with an adjustable strap to mitigate and/or obviate the aforementioned problems.

SUMMARY OF THE INVENTION

Therefore, an objective of an embodiment of the present invention is to provide a buckle for adjusting a length of a strap comprising a first body unit and a locking unit. Preferred embodiment buckles are easier to manufacture while offering improved strength and lifetime.

In order to achieve the above mentioned objective, an embodiment buckle for adjusting a length of a strap includes a first body unit having a first main body that surrounds a containment space. A first through hole and a second through hole are disposed in the first main body, and a first rod is disposed in the containment space. The first main body also include a bottom portion in the containment space. A locking unit is further provided having a columnar shape and is disposed in the containment space. The locking unit includes two flat surfaces, with a side surface connected between an edge of each flat surface, and a supporting aperture that accepts the first rod and which is disposed through both of the flat surfaces. Each side surface further includes a first curved portion, with a vertical surface connected to the first curved portion at one end and a second curved portion connected to another end of the vertical surface. A first protrusion is connected to both of the first curved portion and the second curved portion, and a distance between the second curved portion and the supporting aperture is smaller than a distance between the first curved portion and the supporting aperture. The locking unit is capable of rotating around the first rod to an adjusting position, a first locking position and a second locking position.

A strap enters into the containment space through the first and second through holes and engages with the locking unit, and when the locking unit is rotated to the adjusting position, each vertical surface is moved close to the bottom portion with a distance not smaller than a thickness of the strap, such that the strap is capable of being pulled out from the first through hole. When the locking unit is rotated to the first locking position, the first curved portion and the first protrusion contact the strap against the bottom portion. When the locking unit is rotated to the second locking position, the first curved portion and the first protrusion both press the strap against the bottom portion to lock the strap.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
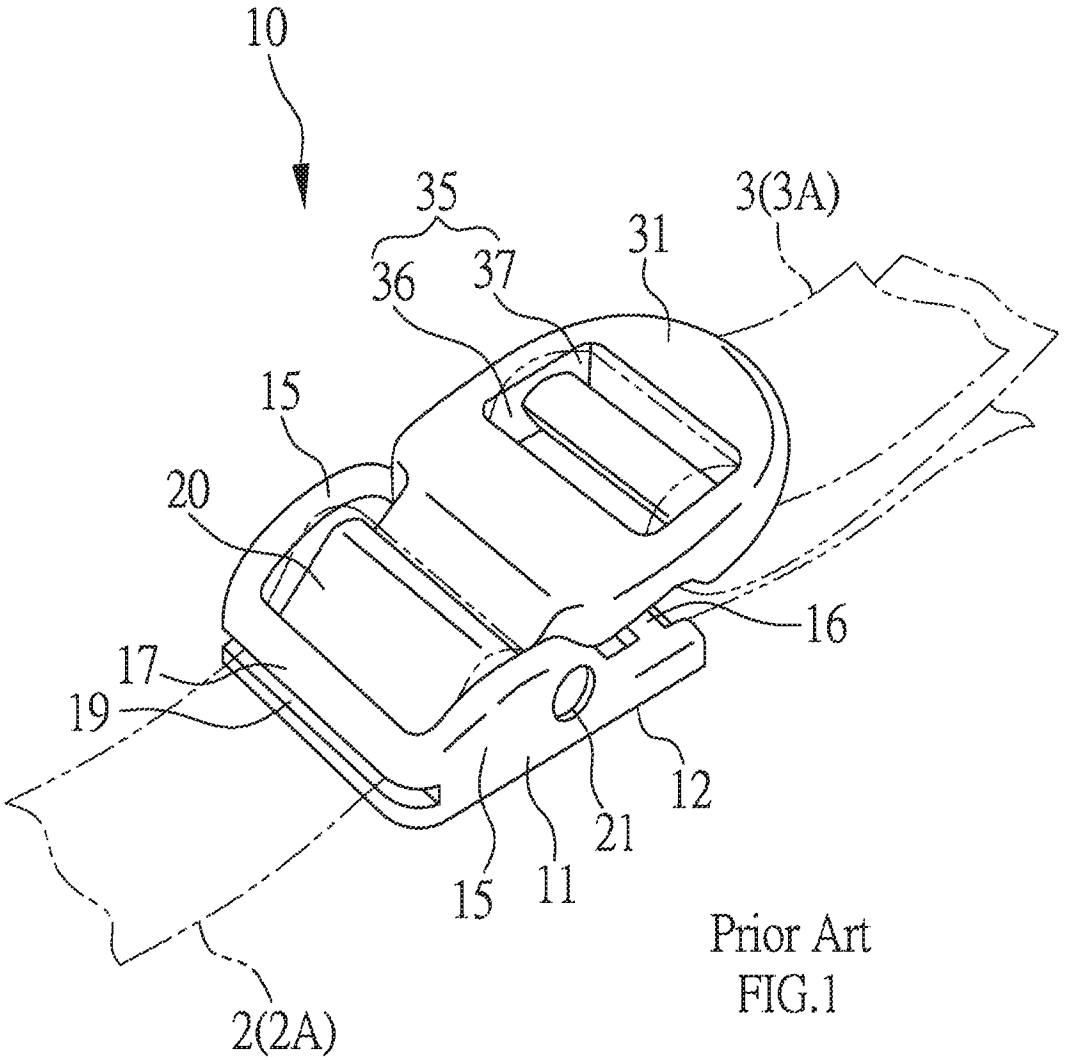
Prior Art FIG.1
FIG. 1 is a schematic drawing of a prior art buckle.
Figure 2:
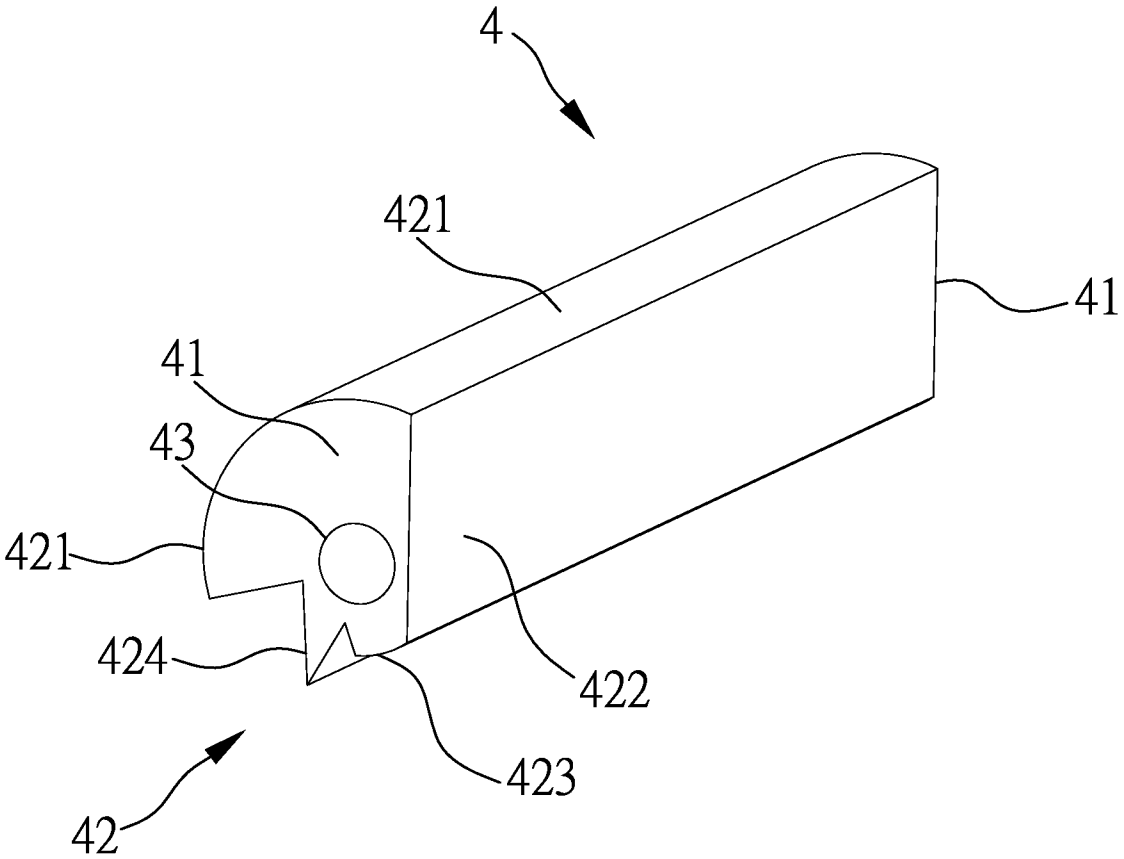
FIG. 2 is a perspective drawing of a locking unit according to a first embodiment of the present invention.

Specific structural and functional details disclosed herein will become apparent from the following description of the preferred embodiments of the present invention taken in conjunction with the accompanying drawings.

Before explaining the present method in detail, it is to be understood that similar elements are labeled with the same number.

Please refer to FIGS. 2, 3, 4 and 5. In a first embodiment of the present invention, a buckle is used for adjusting the length of a strap A, and the buckle comprises a first body unit 3 and a locking unit 4. The first body unit 3 has a first main body 32 surrounding a containment space 31, a first through hole 33 and a second through hole 34 disposed separately on the first main body 32, and a first rod 35 disposed in the containment space 31. The first main body 32 further has a bottom portion 321 in the containment space 31. The strap A enters into the first main body 32 through the first and second through holes 33, 34, such that the strap A is capable of being pulled out from the first through hole 33.

The locking unit 4 has a columnar shape and is disposed in the containment space 31. The locking unit further has two flat surfaces 41, a side surface 42 connected between an edge of each flat surface 41, and a supporting aperture 43 accepting the first rod 35 and disposed through both of the flat surfaces 41. The locking unit 4 is capable of rotating around the first rod 35 to an adjusting position, a first locking position and a second locking position. Each side surface 42 further has a first curved portion 421, a vertical surface 422 connected to the first curved portion 421 at one end and a second curved portion 423 connected to another end of the vertical surface 422, and a first protrusion 424 connected to both of the first curved portion 421 and the second curved portion 423.

The first curved portion 421, the vertical surface 422, the first protrusion 424, and the second curved portion 423 are aligned to form a circle on the side surface 42 of the locking unit 4. Moreover, a distance between the second curved portion 423 and the supporting aperture 43 is smaller than a distance between the first curved portion 424 and the supporting aperture 43. The distance between the first protrusion 424 and the supporting aperture 43 is not larger than the distance between the first curved portion 421 and the supporting aperture 43.

The strap A enters into the containment space 31 through the first and second through holes 33, 34 and engages with the locking unit 4. When the locking unit 4 is rotated to the adjusting position, each vertical surface 422 is moved close to the bottom portion 321 with a distance not smaller than a thickness of the strap, such that the strap is capable of being pulled out from the first through hole 33. When the locking unit 4 is rotated to the first locking position, the first curved portion 421 and the first protrusion 424 contact the strap against the bottom portion 321. When the locking unit 4 is rotated to the second locking position, the first curved portion 421 and the first protrusion 424 both press the strap A against the bottom portion to lock the strap.

In a first embodiment, the locking unit 4 is made of a metal material for longer life time and stronger strength, preferably stainless steel to avoid being oxidized. Furthermore, the first body unit 3 is also made of a metal material or other hard materials.

Figure 3:
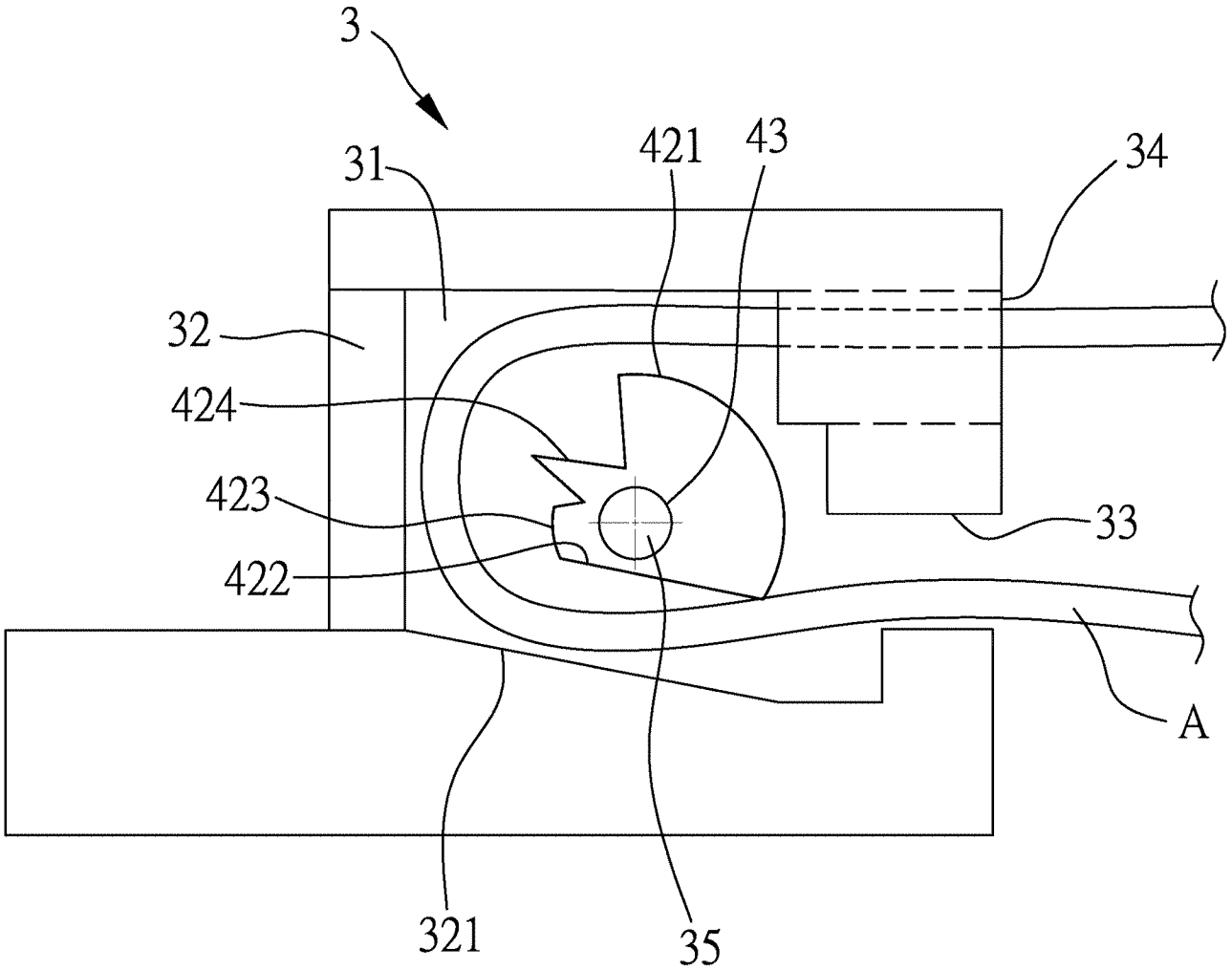
FIG. 3 is a schematic drawing of an adjusting position according to the first embodiment of the present invention.
Figure 4:
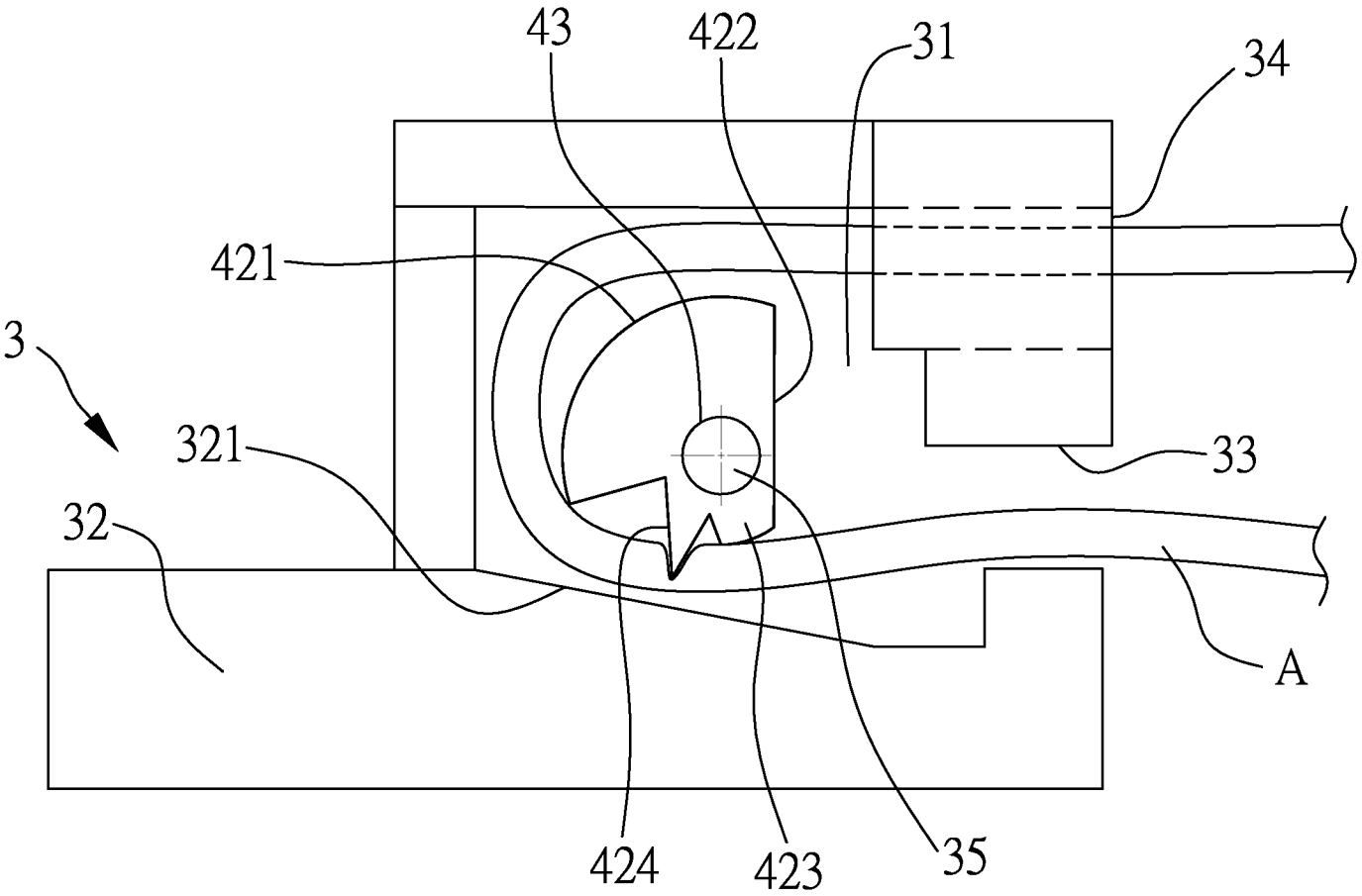
FIG. 4 is a side view of a first locking position according to the first embodiment of the present invention.
Figure 5:
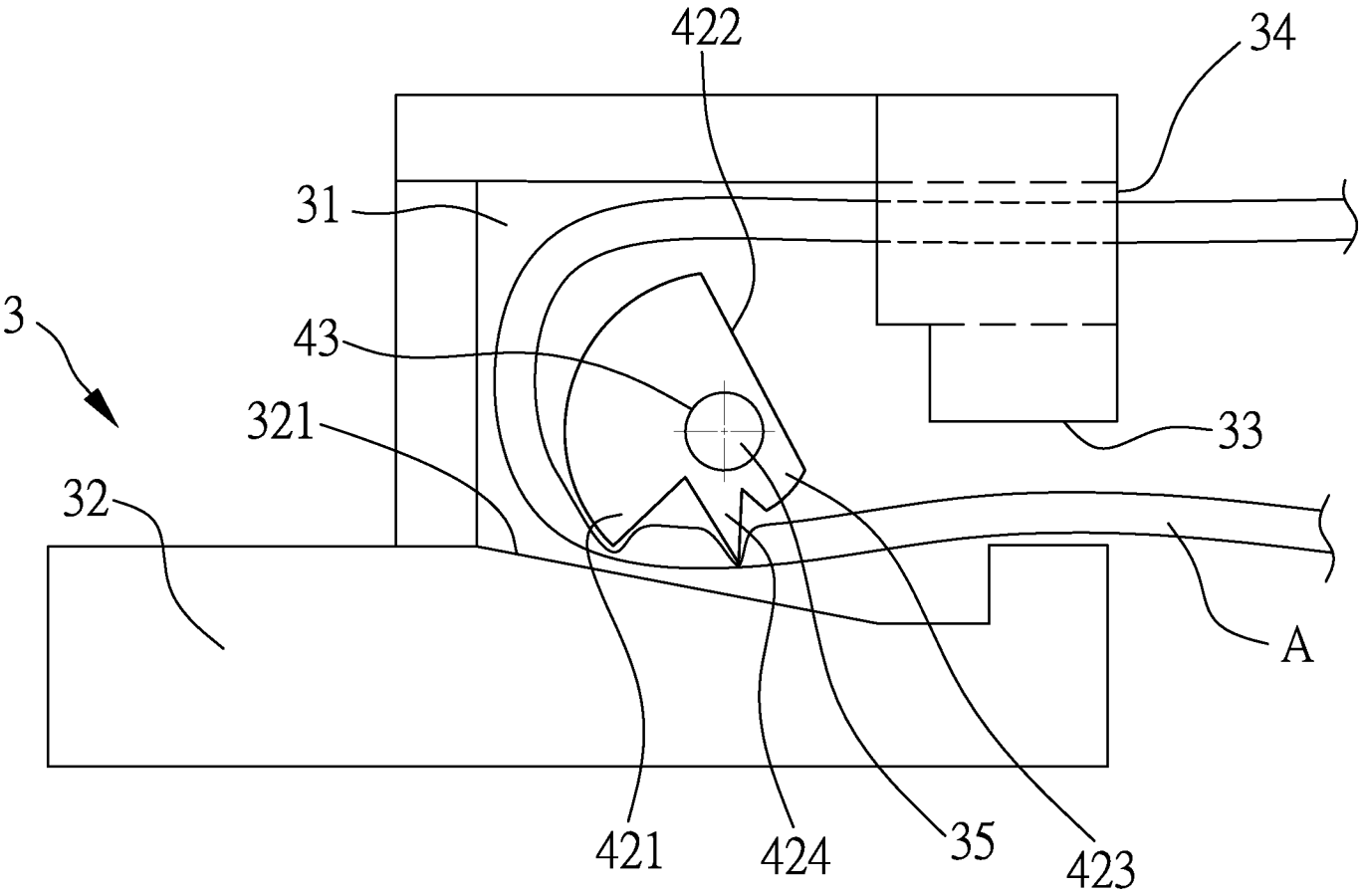
FIG. 5 is a side view of a second locking position according to the first embodiment of the present invention.

Please refer to FIG. 3, FIG. 4 and FIG. 5 again, which show the locking unit 4 is rotated to the adjusting position, the first locking position and the second locking position. When the locking unit 4 is rotated to the adjusting position, the vertical surface 422 of the locking unit 4 is parallel with the bottom portion 321 of the first main body 32 and having a closest distance with each other. In the first embodiment, the strap A is a soft rope with a predetermined thickness, a predetermined width and a predetermined length. The distance between the vertical surface 422 of the locking unit 4 and the bottom portion 321 of the first main body 32 is equal to the thickness of the strap A such that the strap A can be moved between the first and second through holes 33, 34 without being stopped by the locking unit 4, and an user can adjust the length of the strap A extending out from the first through hole 33.

Since the vertical surface 422 is part of the flat surface 41 of the side surface 42, a distance between the second curved portion 423 and the supporting aperture 43 is larger than a distance between a center position of the vertical surface 422 and the supporting aperture 43, and the distance between the first protrusion 424 and the supporting aperture 43 is larger than the distance between the second curved portion 423 and the supporting aperture 43; when the locking unit 4 is rotated to the first locking position, the distance between the second curved portion 423 and the bottom portion and the distance between the first protrusion 424 and the bottom portion 321 are both smaller than the thickness of the strap A; the strap A is pressed down to the bottom portion 321 by the second curved portion 423 and the first protrusion 424 of the locking unit 4, such that the strap A cannot move easily between the first and second through holes 33, 34, and the user can secure the strap A extending form the first through hole 33.

When the user pulls even harder on the strap A from the first through hole 33 can rotate the locking unit 4 from the first locking position to the second locking position, the first curved portion 421 and the first protrusion 424 of the locking unit 4 both press the strap A onto the bottom portion 321. Since the distance between the first curved portion 421 and the supporting aperture 43 is larger than the distance between the first protrusion 424 and the supporting aperture 43, the locking unit 4 at the second locking position completely locks the strap A.

In the first embodiment, the distance between the first curved portion 421 and the supporting aperture 43 is larger than the distance between the bottom portion 321 and the supporting aperture 43, when the locking unit 4 is rotated to the second locking position also stopped by the bottom portion 321. Therefore, the locking unit 4 is able to lock down the strap A at the first through hole 33. Since the locking unit 4 is a column with an eccentric axis, while the locking unit 4 is rotated the distance between itself and the bottom portion 321 can be different, which can strongly lock down the strap A. When the user gently pulls the strap A through the first through hole 33, the locking unit 4 AT the first locking position secures the strap A in the first main body 32. In addition, the locking unit 4 can also be a triangular prism, rectangular prism or multiple-angular prism with an eccentric axis.

When user pulls the strap A from the second through hole 34, the friction between the strap A and the locking unit 4 rotates the locking unit 4 from the second locking position through the first locking position to the adjusting position, so the user can quickly adjust the strap A out from the first through hole 33.

Figure 6:
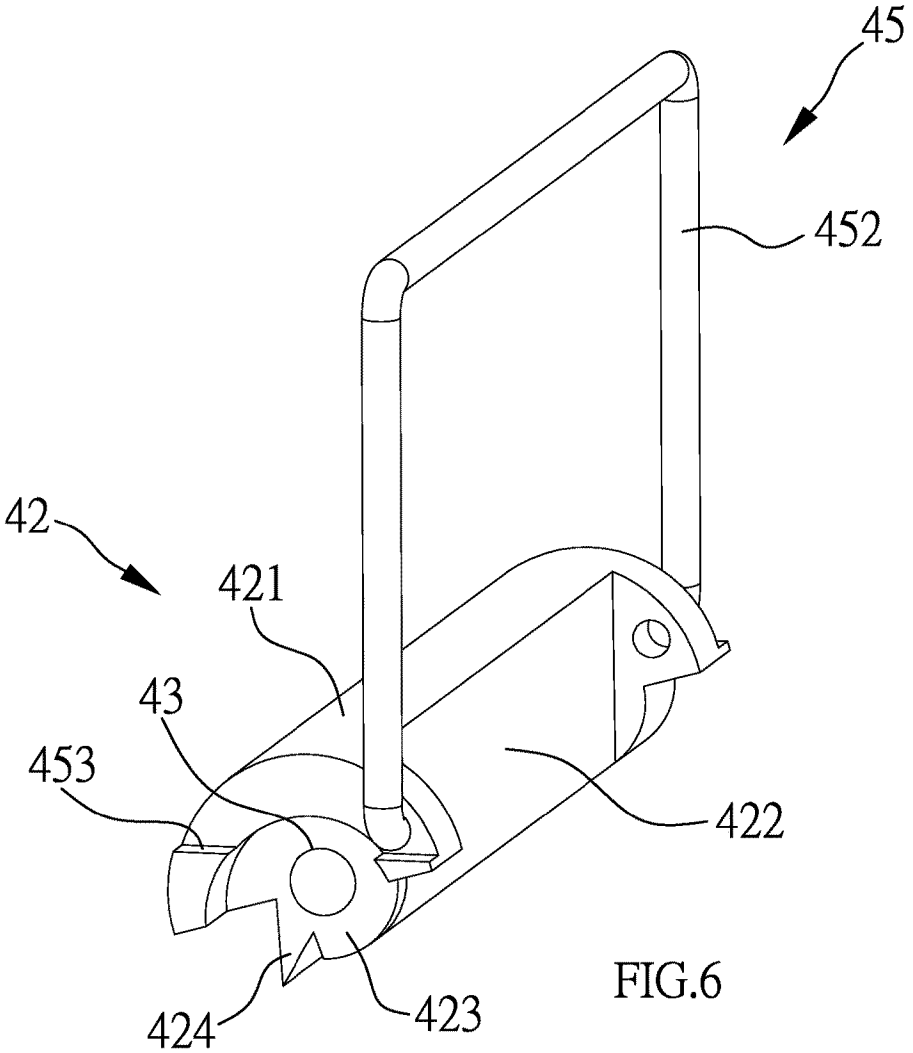
FIG. 6 is a perspective drawing of a locking unit according to a second embodiment of the present invention.
Figure 7:
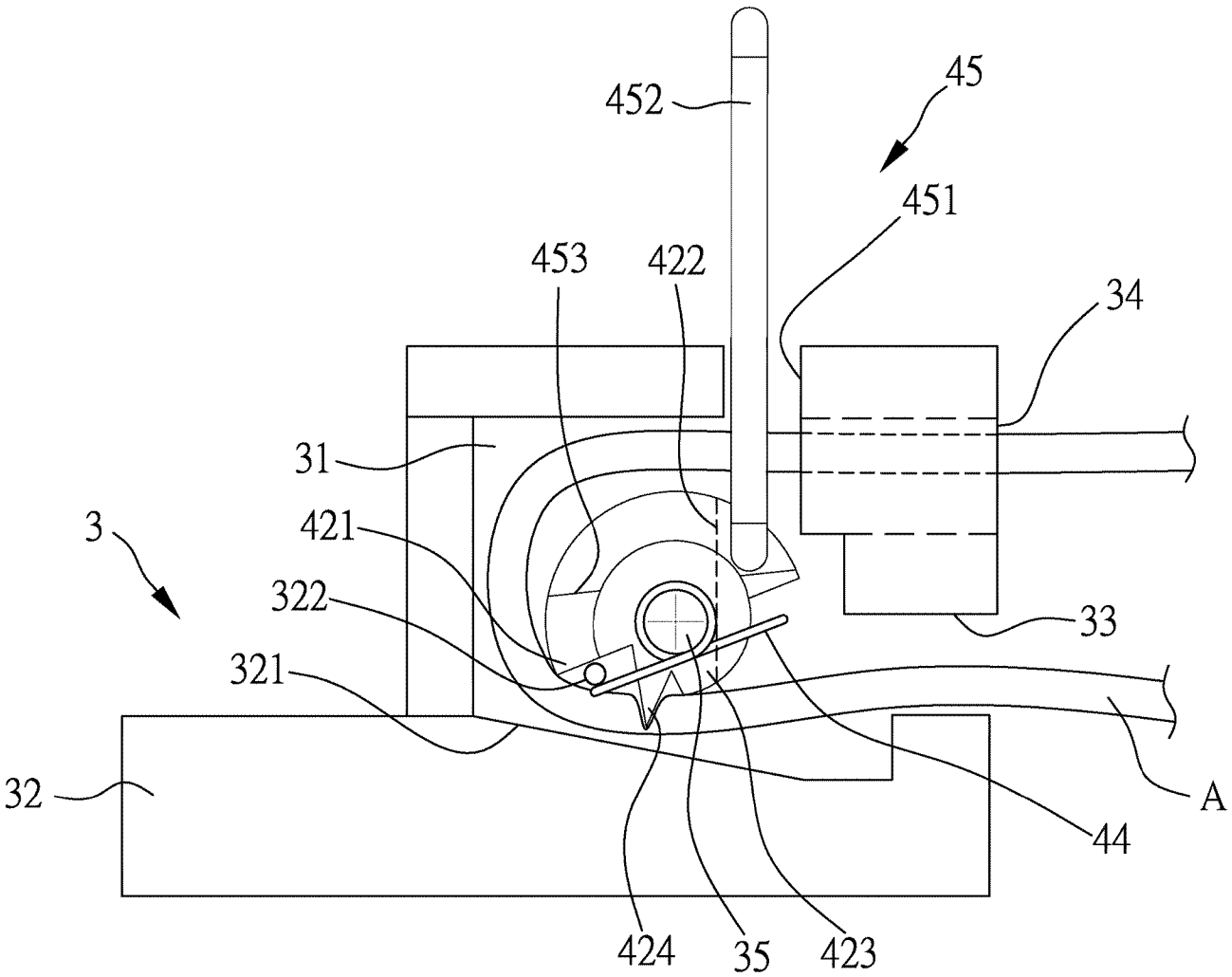
FIG. 7 is a side view of a first elastic member according to the second embodiment of the present invention.
Figure 8:
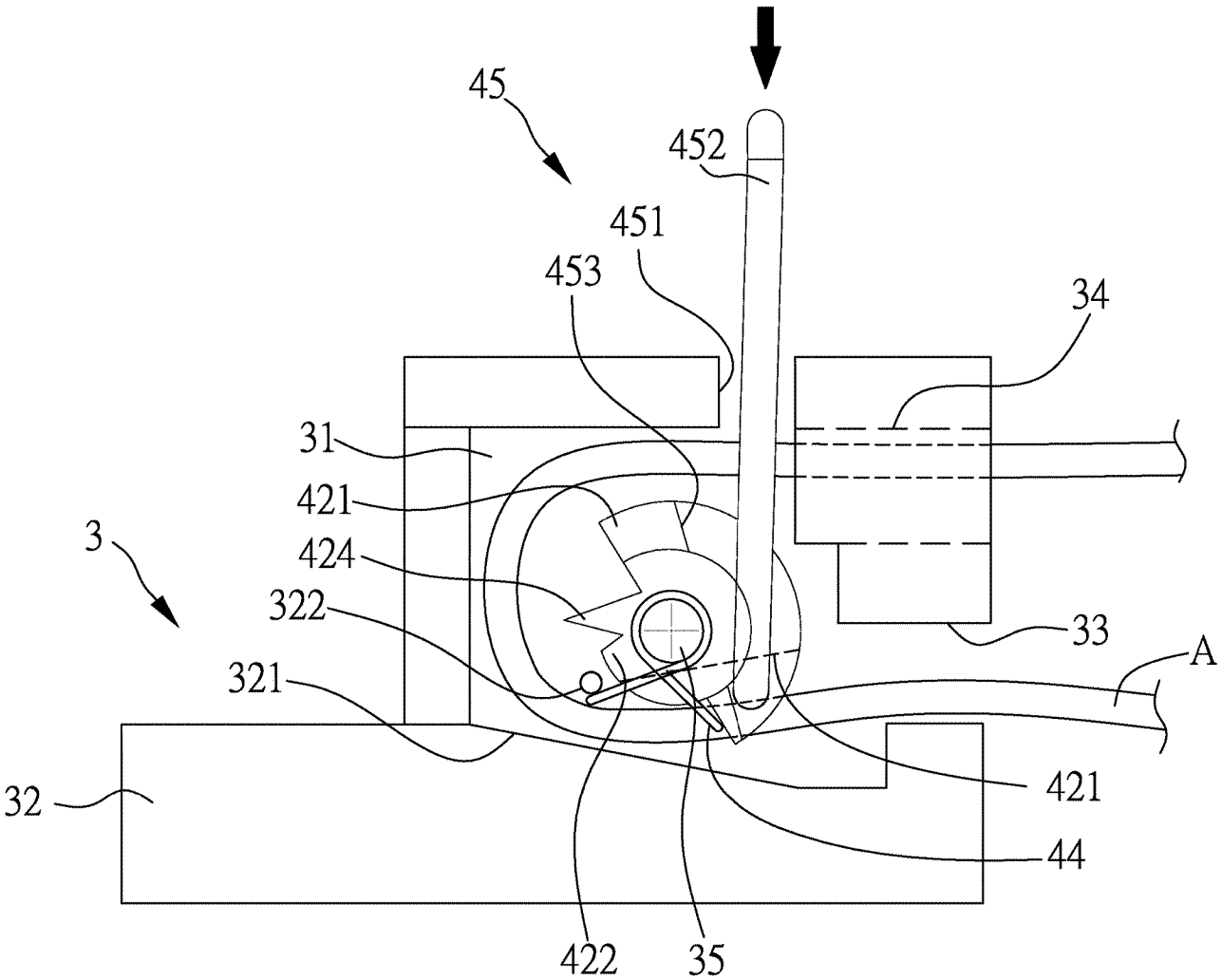
FIG. 8 is a side view of an adjusting member according to the second embodiment of the present invention.

Please refer to FIGS. 6, 7, 8 for a second embodiment of the present invention. The difference between second embodiment and first embodiment is, the locking unit 4 further comprises a first elastic member 44 connected to the first main body 32 and the locking unit 4 and an adjusting member 45. The first elastic member 44 applies force onto the locking unit 4 to make the locking unit 4 to rotate to the second locking position.

Preferably, the first elastic member 44 is attached onto the first rod 35 and also presses against the first main body 32 and the locking unit 4. When the first main body 32 is not containing the strap A, the first elastic member 44 applies force to the locking unit 4 to rotate the locking unit 4 to the second locking position. When the strap A is located within the first body unit 3, the first elastic member 44 can apply force to the locking unit 4 on the second curved portion 423 at the adjusting position to secure the strap A. When the user pulls out the strap A from the first through hole 33, the locking unit 4 will be rotated from the adjusting position to the first locking position; or with a greater force, the locking unit 4 is rotated to the second locking position, in order to prevent the strap A from being pulled out the first through hole 33.

The adjusting member 45 has a pressing aperture 451 disposed on the first main body 32, an adjusting button 452 mounted onto the locking unit 4 protruding from the pressing aperture 451, and a the flat surface 453 disposed on the locking unit 4 and use for blocking the adjusting button for restrictions. The adjusting button 452 can absorb external pressure to against the force applied to the locking unit 4 from the first elastic member 44, even against the pulling force applied to the strap A and rotate the locking unit 4 to the adjusting position.

In the second preferred embodiment, the distance between the first curved portion 421 and the supporting aperture 43 is not greater than the distance between the bottom portion 321 and the supporting aperture 43, and the first main body 32 further has a limiting protrusion 322 disposed in the containment space 31 and used for limiting the rotation angle of the locking unit 4. When the locking unit 4 is rotated to the second locking position, it is stopped by the limiting protrusion 322. When the strap A is pulled from the through hole 33, the locking unit 4 pushes strap A onto the bottom portion 321, and the limiting protrusion 322 provides reaction force to avoid the strap A from being pulled out the first through hole 33.

Preferably, in the second preferred embodiment, the first elastic member 44 pushes against the limiting protrusion 322 of the first main body 32, and the locking 4 is limited onto the flat surface 453. The limiting protrusion 322 support the first elastic member 44, and the first elastic member 44 uses elastic force to rotate the locking unit 4. Due to the variety of types of springs, the actual implementation should not be limited thereto.

When the user wants to shorten the length of the strap A, he or she can directly pull the strap A extending through the second through hole 34, the strap A will resist the first elastic member 44 and puling force from the first through hole 33 and rotate the locking unit 4 to the adjusting position, therefore, the strap A can be placed into the containment space 31 through the first through hole 33 pulled out from the second through hole 34, to shortened the strap A length extending from the first through hole 33.

Conversely, when the user wants to increase the length of the strap A, he or she can press the adjusting button 452 extending from the pressing aperture 451, the strap A resists the first elastic member 44 and rotates the locking unit 4 to the adjusting position, then the strap A can be pulled out from the first through hole 33 to increase the length of the strap A from the first through hole 33.

Figure 9:
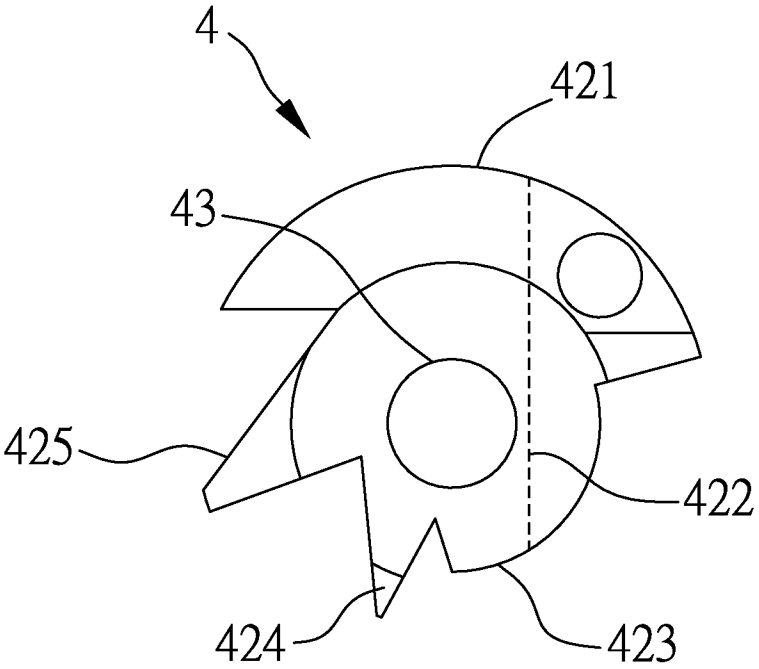
FIG. 9 is a side view of the buckle according to a third embodiment of the present invention.

Referring to FIG. 9 for a third preferred embodiment of the present invention. The third preferred embodiment and the second preferred embodiment are substantially the same, except that the side surface 42 further has a second protrusion 425 disposed between the first protrusion 424 and the first curved portion 421.

When the locking unit 4 is rotated to the second locking position, the first protrusion 424, the first curved portion 421 and the second protrusion 425 in-between touch the strap A at the same time and press the strap A onto the bottom portion 321, to increase holding strength between the locking unit 4 and the strap A which improve loading effect of the buckle device.

In the third preferred embodiment, the first protrusion 424 and the second protrusion 425 is cone-shaped in cross-section aspect together, and the first curved portion 421 is also showing with cone-shaped aspect. When the locking unit 4 is at the first locking position and the second locking position, the strap A can be pressed against the bottom portion 321. For the actual implementation, the first and second protrusions 424, 425 and the shape edge of the first curved portion 421 may also have other shapes to press the strap A at the first main body 32.

Figure 10:
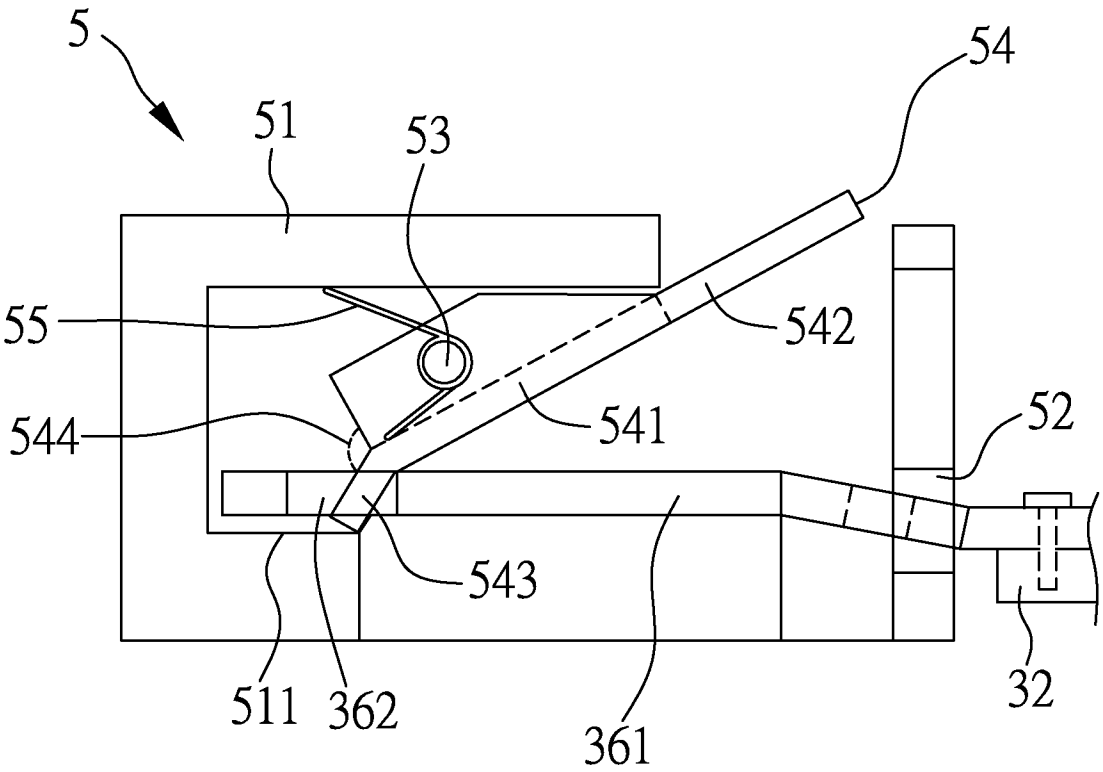
FIG. 10 is a side view of an interference position according to a fourth embodiment of the present invention.
Figure 11:
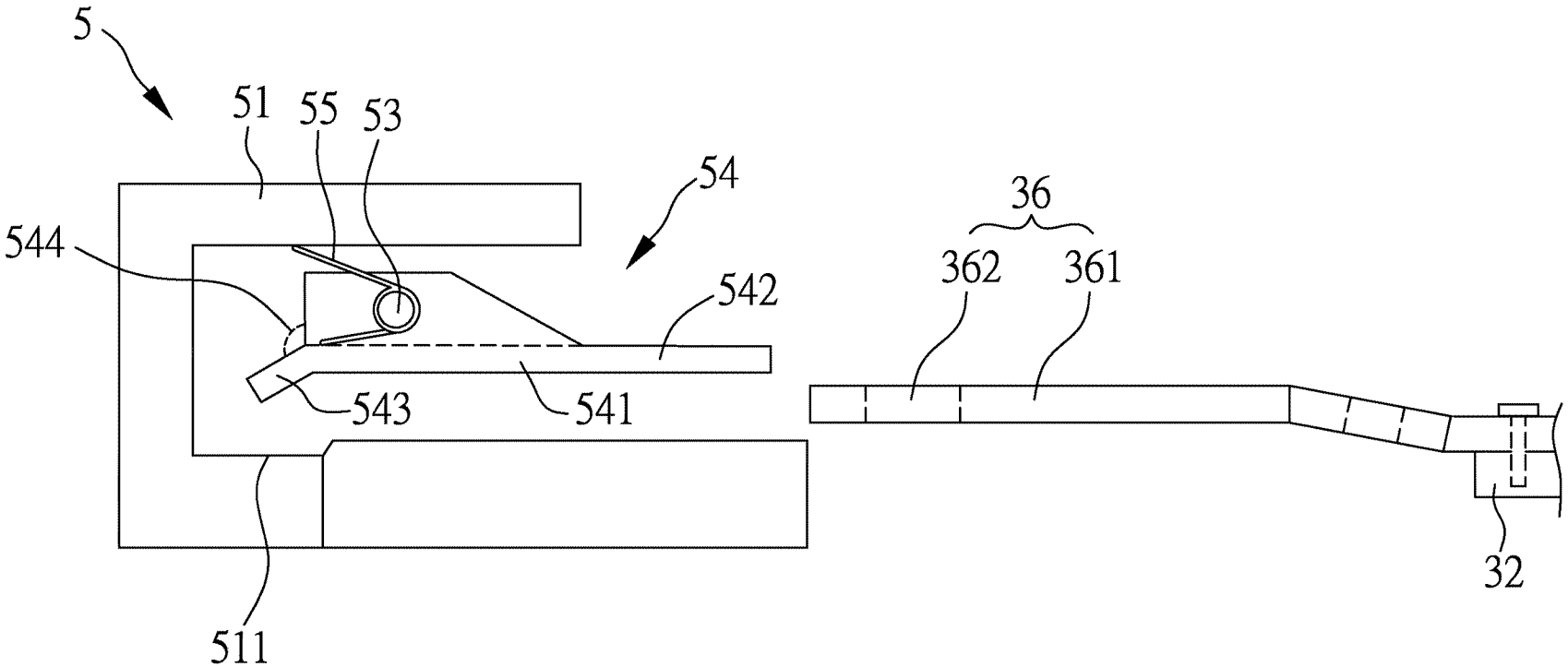
FIG. 11 is a side view of a non-interference position according to the fourth embodiment of the present invention.

Referring to FIG. 10, 11 for a fourth preferred embodiment of the present invention. The fourth preferred embodiment and the second preferred embodiment are substantially the same, in this not repeat the same, except that the first body unit 3 further has a first protruding body 36, and the first protruding body 36 further includes a first flat tongue 361 outwardly extending from the first main body 32 and a first aperture 362 disposed on the first flat tongue 361.

The buckle of embodiments of the present invention further comprises a second body unit 5, which includes a second main body 51, a the installation slot 52 disposed on the second main body 51 and used for accepting the first flat tongue 361, a second rod 53 disposed on the second main body 51, and a pressing rod 54 capable of rotating around the second rod 53. The pressing rod 54 is capable of rotating between an interference position and a non-interference position. When the pressing rod 54 is rotated to the interference position, the pressing rod 54 can be inserted into the first aperture 362 and interfering with the first protruding body 36, such that the first main body 32 and the second main body 51 combine together. When the pressing rod 54 is rotated to the non-interference position, the pressing rod 54 leaves the first aperture 362 to make the first protruding body 36 to pull away from the installation slot 52.

The pressing rod 54 has a middle section 541 pivoted onto the second rod 53, a pressing section 542 disposed at one end of the middle section 541 and protruding from the second main body 51, and a stopping section 543 disposed on an opposite end of the middle section 541. The stopping section 543 of the pressing rod 54 is bent downward and forms a V-shaped included angle 544 with the middle section 541. The second main body 51 has an indentation 511 capable of accepting the stopping section 543. When the first protruding body 36 is inserted into the installation slot 52 and the pressing rod 54 is located at the interference position, the stopping section 543 passes through the first aperture 362 so that the first flat tongue 361 is located in the V-shaped included angle 544.

The second body unit 5 further includes a second main body 55 connecting between the second elastic member 51 and the pressing rod 54 to make the pressing rod 54 at the non-interference position to rebound back to the interference position. Preferably, the second elastic member 55 is placed onto the second rod 53, one end of second elastic member 55 pushes against the second main body 51, and the other end pushes against the surface of the pressing rod 54.

When the user wants to combine the first body unit 3 with the second body unit 5, he or she can place the first flat tongue 361 into the installation slot 52 and pushing against the bottom of the pressing rod 54, so that the pressing rod 54 is propped up from the interference position to be propped up, then the first flat tongue 361 slides into the bottom of the pressing rod 54. When the first aperture 362 slides under the stopping section 543, the stopping section 543 is accepted into the first aperture 362 and placed in the indentation 511 so that the second elastic member 55 rotates the pressing rod 54 to the interference position. Therefore, the first protruding body 36 and the pressing rod 54 interfere with each other such that the first body unit 3 and the second body unit 5 combines together.

The stopping section 543 of the pressing rod 54 is bent downward at a predetermined angle, and a structural height of the middle section 541 is increased, such that the stopping section 543 and the middle section 541 form the V-shaped included angle 544. When a combination of the second body unit 5 and the first body unit 3 are pulled outwardly, the first aperture 362 of the first protruding body 36 engage with the V-shaped included angle 544 such that the first body unit 3 of the buckle of the present invention not only can be tightly locked but also able to resist greater tension for a larger load strength.

When the user wishing the first body unit 3 and the second separation unit 5 when body, the pressing section 542 can be pressed to the pressing rod 54 is rotated to non-interference position, so that the stopping section 543 made the first aperture 362 in detached, the pressing rod 54 and the first protruding body 36 after the separation so that the first body unit 3 can and the second body unit 5 separation.

Figure 12:
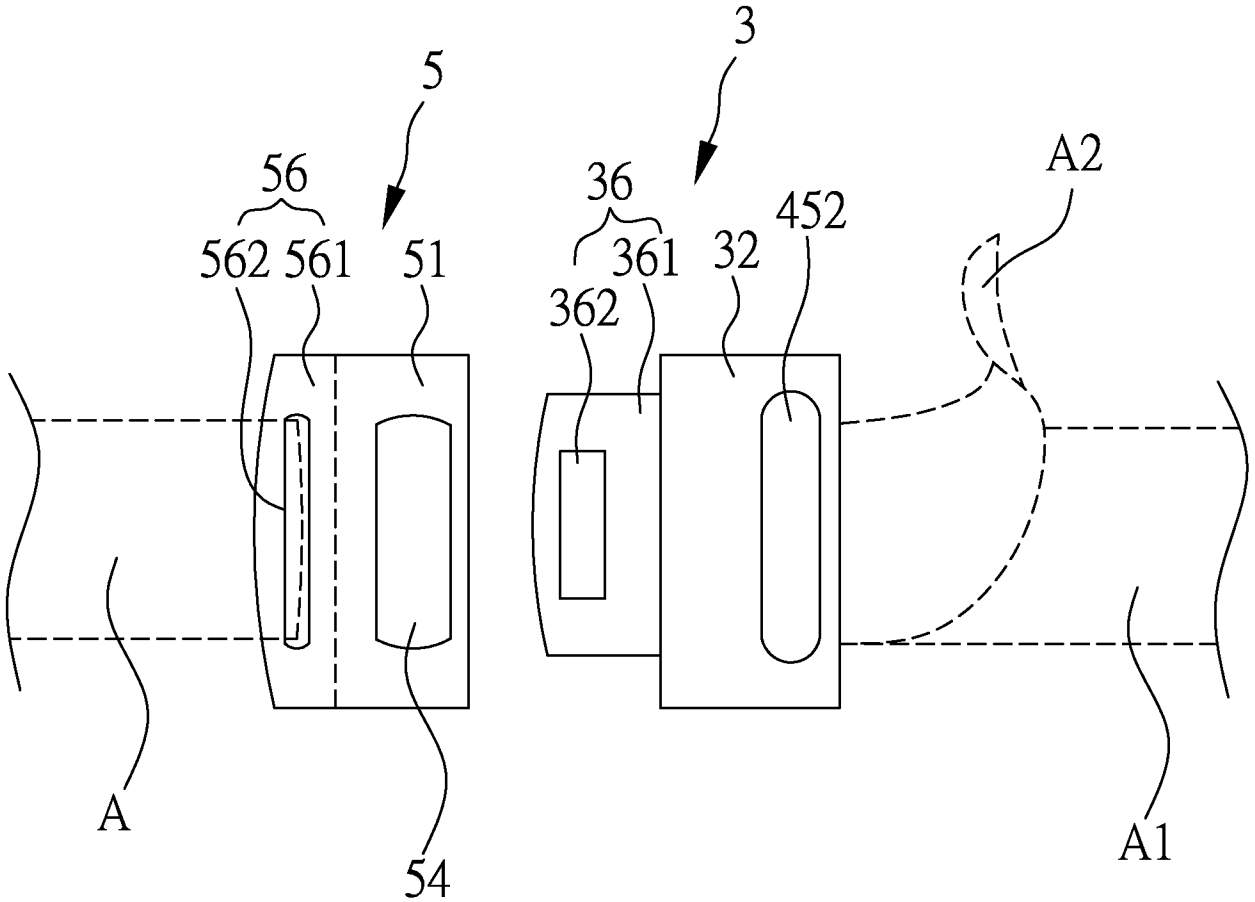
FIG. 12 is a schematic drawing of the buckle according to a fifth embodiment of the present invention.

Referring to FIG. 12 for a fifth preferred embodiment of the present invention. The fifth preferred embodiment and the fourth preferred embodiment is substantially the same, except that the second body unit 5 further includes a second protrusion 56, the second protrusion 56 has a second flat tongue 561 extending from the second main body 51 outwardly, and a second hole 562 disposed on the second flat tongue 561. Wherein the strap A1 is the part of the strap A pulled out of the first through hole 33, and the strap A2 is the part of the strap A pulled out of the second through hole.

In the fifth preferred embodiment, the adjusting button 452 of the adjusting member 45 and the stopping section 543 of the pressing rod 54 are designed as buttons, when the user places the first body unit 3 with the second main body 5 together, he or she can then press the stopping section 543 to separate the first and second main body 3, 5.

In order to adjust the length of the strap A1, by pressing the adjusting button 452 of the adjusting member 45 to pull the strap A1 pulled outwardly through the first through hole 33, the length of the strap A1 is increase. In order to shorten the length of the strap A1, by pulling the strap A2 through the second through hole 34, length of the strap A1 through the first through the hole 33 is shorten.

The user can then use the second hole 562 of the second protrusion 56 to tie the strap A securely, so the buckle of the present invention can be used in a variety of applications. For example, it can be used as a backpack buckle, for the backpack, belt buckle, or cargo trucks loading strap buckle.

With the above-mentioned structure, following advantages can be obtained:

1. Capable of Withstand Greater Tension

The locking unit 4 of the present invention utilizes eccentric concept to quickly lock the strap A, and with the first curved portion 421 and the first protrusion 424 also strengthen the locking strength applied to the strap A, The first aperture 362 of the first protruding body 36 is placed in V-shaped included angle of the pressing rod 54 when the first and the second main body 32, 51 are combined, such that the buckle of the present invention can be subjected to greater tension.

Quick Strap Length Adjustment

By pressing the adjusting button 452, the locking unit 4 can be quickly rotated to the adjusting position for increasing the length of the strap A, and by directly pulling the strap A through the second through hole 34 for shortening short length of the strap A.

Quick Assembly

The user can directly push the first protrusion of the first body unit 3 into the second body unit 5 to combine the first and second main body 3, 5 and press of the pressing section 542 of the pressing rod 54 to separate the first and second main body 3, 5 apart.

In summary, the locking unit 4 of the first body unit 3 can be rotated to the adjusting position, the first and second locking position, so not only the length of the strap A can be quickly adjusted but also have greater bearing strength. the eccentric design of the locking unit 4 also provides faster locking speed. With the pressing rod 54 of the second body unit 5 makes the first and second main body 3, 5 to be combined and separated easily.

Consequently, labor is reduced to increase production efficiencies and it can ensure production lead times to assist the industries with controlling their manufacturing processes. Therefore, the above methods can achieve the objective of the present invention.

The foregoing detailed description is merely in relation to two preferred embodiments and shall not be construed as limiting the invention. It is to be understood that many other possible modifications and variations can be made without departing from the spirit and scope of the invention as hereinafter claimed.

What is claimed is:

1. A buckle for adjusting a length of a strap, the buckle comprising:

a first body unit having a first main body surrounding a containment space, a first through hole and a second through hole disposed separately on the first main body, and a first rod disposed in the containment space, the first main body further having a bottom portion in the containment space; and a locking unit having a columnar shape and disposed in the containment space, the locking unit further having two flat surfaces, a side surface connected between an edge of each flat surface, and a supporting aperture accepting the first rod and disposed through both of the flat surfaces, each side surface further having a first curved portion, a vertical surface connected to the first curved portion at one end and a second curved portion connected to another end of the vertical surface, and a first protrusion connected to both of the first curved portion and the second curved portion;

wherein:

a distance between the second curved portion and the supporting aperture is smaller than a distance between the first curved portion and the supporting aperture, and the locking unit is capable of rotating around the first rod to an adjusting position, a first locking position and a second locking position;

the strap enters into the containment space through the first and second through holes and engages with the locking unit, and when the locking unit is rotated to the adjusting position, each vertical surface is moved close to the bottom portion with a distance not smaller than a thickness of the strap, such that the strap is capable of being pulled out from the first through hole, when the locking unit is rotated to the first locking position, the first curved portion and the first protrusion contact the strap against the bottom portion, and when the locking unit is rotated to the second locking position, the first curved portion and the first protrusion both press the strap against the bottom portion to lock the strap;

when the strap is pulled through the second through hole, the locking unit is turned by the strap to the adjusting position such that the strap is capable of being pulled out through the second through hole;

the locking unit further comprises an adjusting member, and a first elastic member connected to the first main body and the locking unit, the first elastic member biasing the locking unit to rotate to the second locking position, a pressing aperture disposed on the first main body, an adjusting button mounted onto the locking unit protruding from the pressing aperture, and a flat surface disposed on the locking unit and used for blocking the adjusting button for restrictions;

the first main body further comprises a limiting protrusion disposed in the containment space, for limiting the locking unit;

each side surface further comprises a second protrusion disposed between the first protrusion and the first curved portion;

the first body unit further comprises a first protruding body, the first protruding body having a first flat tongue extending outwardly from the first main body and a first aperture disposed on the first flat tongue; and the buckle further comprises a second body unit, the second body unit having a second main body, an installation slot disposed on the second main body and accepting the first flat tongue, a second rod disposed on the second main body, and a pressing rod rotating around the second rod, the pressing rod capable of rotating between an interference position and a non-interference position;

wherein when the pressing rod is rotated to the interference position, the pressing rod can be inserted into the first aperture to interfere with the first protruding body and couple the first main body and the second main body together, and when the pressing rod is rotated to the non-interference position, the pressing rod is pulled out of the first aperture to remove the first protruding body from the installation slot.

2. The buckle as claimed in claim 1, wherein the pressing rod has a middle section pivoted with the second rod, a pressing section disposed at one end of the middle section, and a stopping section disposed at another end of the middle section, the stopping section of the pressing rod bent to form a V-shaped included angle with the middle section, the second main body further having a depression for accepting the stopping section;

wherein when the first protruding body is inserted into the installation slot and the pressing rod is at the interference position, the stopping section passes through the first aperture to place the first flat tongue in the V-shaped included angle.

3. The buckle as claimed in claim 1, wherein the second body unit further comprise a second elastic member connected to the second main body and the pressing rod, which can pull the pressing rod from the non-interference position back to the interference position.

* * * * *